United States Patent [19]

Ramirez

[11] 3,937,116

[45] Feb. 10, 1976

[54] TENOR TROMBONE CONSTRUCTION

[75] Inventor: Lawrence Ramirez, Kenosha, Wis.

[73] Assignee: G. Leblanc Corporation, Kenosha, Wis.

[22] Filed: Oct. 21, 1974

[21] Appl. No.: 516,530

[52] U.S. Cl. ..... 84/395
[51] Int. Cl.[2] ..... G10D 7/10
[58] Field of Search ..... 84/395, 396

[56] References Cited

UNITED STATES PATENTS

| | | | |
|---|---|---|---|
| 932,704 | 8/1909 | Holton | 84/395 |
| 2,288,743 | 7/1942 | Reed | 84/395 |
| 2,446,378 | 8/1948 | Maxwell | 84/395 X |

OTHER PUBLICATIONS

"Really Doubling in Brass," In Popular Science,, May, 1946, p. 81.

*Primary Examiner*—John F. Gonzales
*Attorney, Agent, or Firm*—Olson, Trexler, Wolters, Bushnell & Fosse, Ltd.

[57] ABSTRACT

The embodiment of the invention disclosed herein is directed to a novel tenor trombone construction. The tenor trombone is capable of performing as a standard slide trombone and/or as a piston valve trombone. The trombone can be operated in these two modes simultaneously or individually. The piston valves can be manipulated by the left hand of the user while the slide member can be manipulated by the right hand, without requiring the player to remove either hand from its normal playing position, or from interrupting his hold on the instrument while playing. The piston valves are so positioned as to enable the user to operate the piston valves with the right hand. Holder means is provided for the slide member assembly to hold it in place when the piston valves are being manipulated by the right hand.

4 Claims, 5 Drawing Figures

TENOR TROMBONE CONSTRUCTION

BACKGROUND OF THE INVENTION

This invention relates generally to musical instruments, and more particularly to a novel trombone construction.

Heretofore, trombones have been provided with slide members for producing a plurality of different sounds. The slide member is so designed as to provide the trombone with seven full positions or half-steps. Some prior art trombones provide an extended musical range by the use of rotary valve devices which change the effective length of the musical chamber. These trombones being commonly referred to as bass trombones. The disadvantage of such bass trombones is that while the musical range is extended it is nevertheless limited.

The trombonist in this modern day is living in a time of new and adventurous sounds. This trend brings a sense of handicap to the person playing a standard slide trombone, a standard valve trombone, or a bass trombone because of the limited range that prior art trombones provide. One problem that has risen with the coming of modern music is that of expressing one's spontaneous feelings while performing. This is very difficult to accomplish with prior art trombones.

SUMMARY OF THE INVENTION

Accordingly, a new and novel trombone construction is hereby provided which includes a slide for providing seven full positions or half-steps and further includes three uniformly spaced apart parallel piston valves. The piston valves are such that the first piston provides a whole tone, the second piston provides a half tone, and the third piston provides a whole tone and a half. Thus, a complete chromatic scale can be played on either the slide section of the trombone or on the valve section. This instrument can be readily operated by a player without requiring that he remove either hand from the normal playing position on the instrument.

With the trombone of this invention, many different kinds of musical ornaments can be obtained with each of the piston valves, while still other kinds of effects can be obtained and expressed by the slide member.

The bottom register of the musical instrument of this invention can be substantially extended by utilizing the piston valves and the slide member simultaneously. This feature not only fills in the gap that is found in all conventional valve and slide tenor trombones from between low E natural and pedal tone B flat concert, but also provides musical effects that heretofore have not been obtainable with either the slide or the piston valve types of trombones. The novel construction of the trombone disclosed herein enables the user to manipulate the piston valves with either the right hand or the left hand in a trumpet-like fashion to obtain many new musical effects.

Many other objects, features and advantages of this invention will be more fully realized and understood from the following detailed description when taken in conjunction with the accompanying drawings wherein like reference numerals throughout the various views of the drawings are intended to designate similar elements and components.

DETAILED DESCRIPTION OF THE ILLUSTRATED EMBODIMENT

Figure 1:
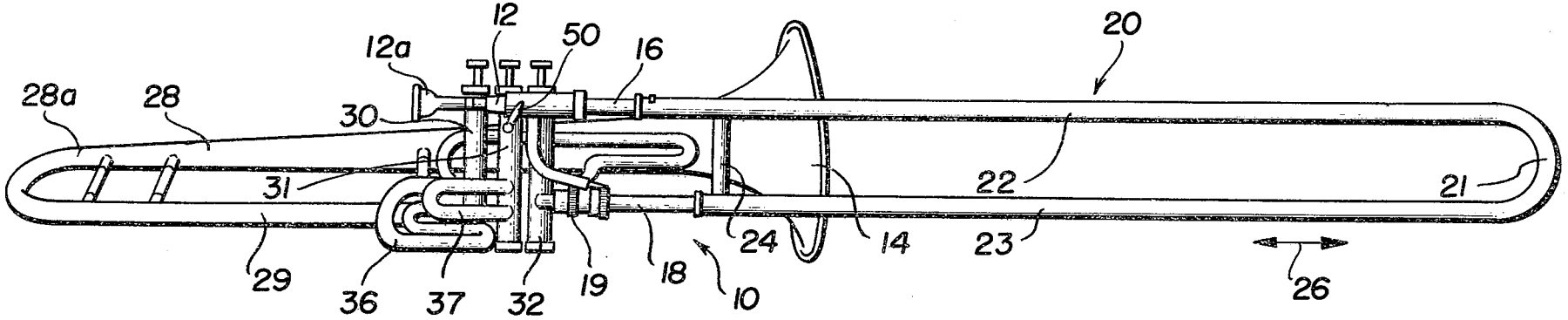
FIG. 1 is a side view of a trombone constructed in accordance with the principles of this invention.
Figure 2:
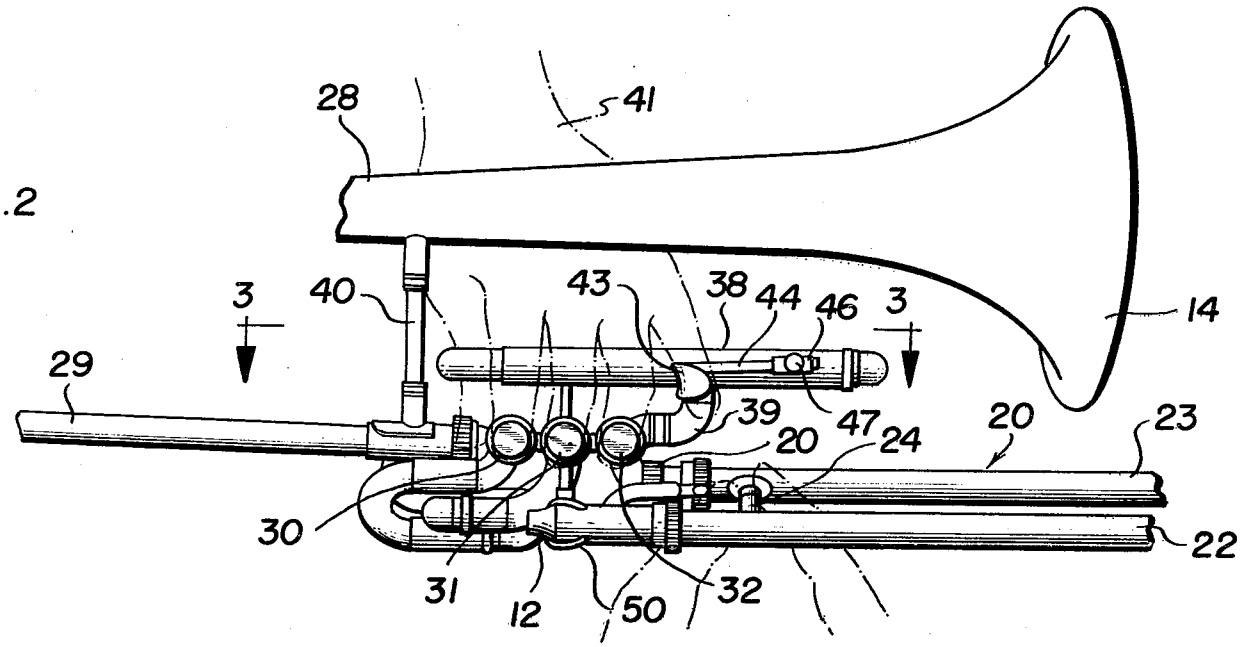
FIG. 2 is a fragmentary top view of the trombone of FIG. 1 illustrating the manipulation of both the piston valves and the slide member by hands shown in phantom line.
Figure 3:
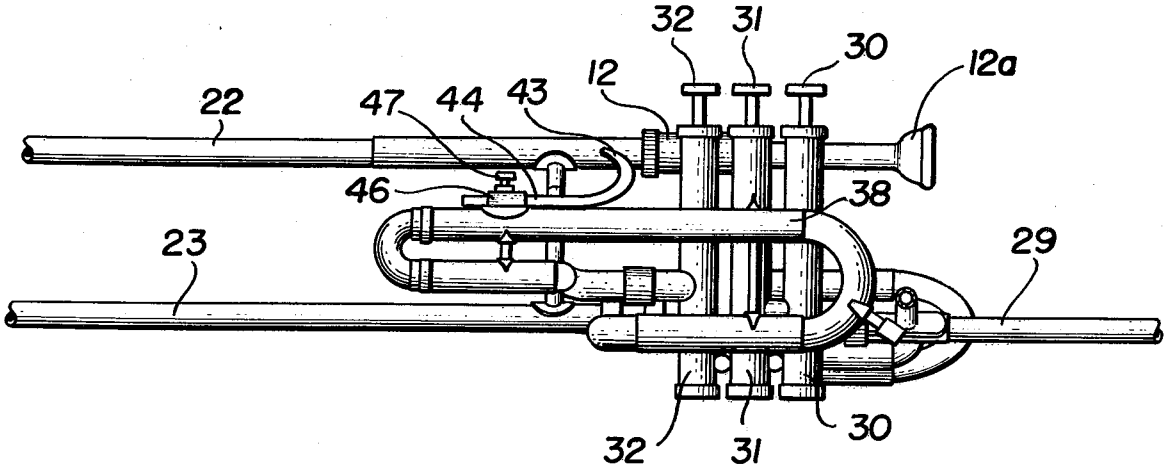
FIG. 3 is a fragmentary view of the trombone shown in FIG. 1 illustrating the opposite side thereof.

Referring now to the drawings, there is seen a trombone constructed in accordance with the principles of this invention and designated generally by reference numeral 10. The trombone 10 is formed of a plurality of tubular metal members secured together in a manner well-known in the art. The tubular metal members are provided with a mouthpiece receiving end portion 12 at one end and a soundemanating bell portion 14 at the other end. A pair of parallel spaced apart tube members 16 and 18 is secured to the trombone in a conventional and well-known manner. For example, the tubular member 18 is removably threadedly secured to the trombone body by a lock nut or threaded collar 19. This enables the tubular member 16 to pivot about the axis of the tubular member 18 to position the mouthpiece at a desired location.

A slide member 20 is provided with a U-shaped end portion 21 leading into a pair of straight spaced apart, parallel portions 22 and 23. The spaced apart portions 22 and 23 are maintained in a substantially fixed parallel position relative to one another by means of a brace 24, which also serves as a holder for manipulating the slide element. The slide 20 is manipulated back and forth as indicated by the double arrowed line 26 for producing a multitude of different musical notes.

The sound-emanating bell portion 14 leads into a tapered tubular metal member 28 which, in turn, passes through a U-shaped end portion **28*a* and therefrom into a tubular portion 29** of substantially uniform diameter throughout its length.

In accordance with one aspect of this invention, the tubular section 29 is secured to a first piston valve assembly 30. Second and third piston valve assemblies 31 and 32, respectively, are provided in parallel spaced relation with the valve 30. Most advantageously, the piston valve assemblies 30, 31 and 32 are positioned adjacent the mouthpiece receiving end portion 12 of the trombone to enable the user thereof to manipulate the piston valves in a trumpetlike fashion with either the left hand or the right hand.

Interconnecting tubings 36 and 37 are provided between the various ports of the piston valve assemblies to enable the user to obtain the various notes. For example, the first piston valve, when depressed, will produce a whole tone, the second piston valve will produce a half tone, and the third piston valve will produce a whole tone and a half. Therefore, a complete chromatic scale can be played on either the slide member 20 or by the piston valves 30, 31 and 32.

A tubular support member 38 is made sufficiently large and positioned next to the piston valves to facilitate holding of the trombone. Therefore, the user of the trombone can support it entirely by the left hand while manipulating the piston valves with the fingers of the left hand. The tubular member 38 is in communication with the third piston valve 32 by means of an elbow passage member 39.

A brace 40 is secured between the end of the tubular section 29 and the gradually tapering portion 28 to provide sufficient strength for the trombone and to insure proper spacing for the user's hand, as indicated in phantom line and designated by reference numeral 41. A finger grip 43 is provided adjacent the piston valves. The finger grip 43 is secured to the end of a rod 44 which passes through a boss member 46 and locks in place by a hand thread screw 47. Therefore, the finger grip 43 can be adjusted to suit the player.

Figure 4:
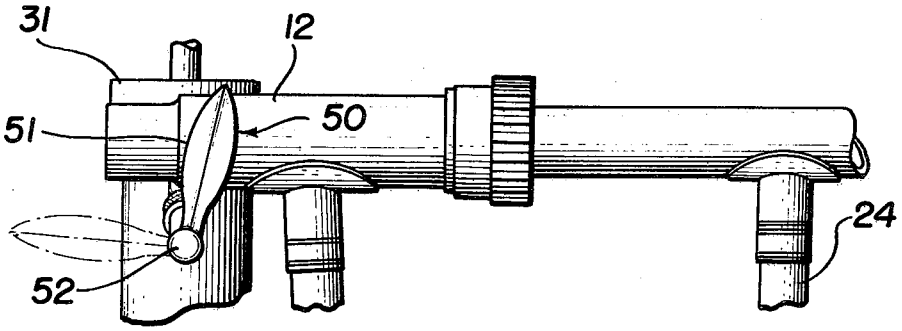
FIG. 4 is an enlarged fragmentary view illustrating retainer means for holding the slide member from pivoting while the piston valves are being manipulated with the right hand.
Figure 5:
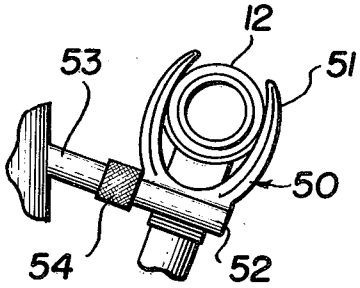
FIG. 5 is a fragmentary end view of the mouthpiece receiving portion being held in place by the holding member.

In accordance with another aspect of this invention, a slide assembly holder 50 is pivotally secured to the trombone and selectively engageable with the top portion of the slide assembly comprising tubular members 16 and 22. The slide holder 50 engages the slide assembly near the mouthpiece receiving end portion 12. The slide holder 50 comprises a U-shaped member 51 having a boss member 52 pivotally secured to a stem 53. The stem 53 is secured to and extends from the middle piston valve assembly 31. When the trombone is to be played only by means of the piston valves 30, 31 and 32 the user may desire to lock the slide assembly in a fixed position relative to the piston valves so that the trombone can be played in the same manner as a trumpet with either the left or the right hands. The holder 50 therefore can be locked in place by a threaded collar 54. If it is desirable to pivot the mouthpiece receiving end portion 12 of the trombone about the tubular member 18 to displace the mouthpiece from the piston valves, the holder 50 is then pivoted in a downward position, as shown in phantom line of FIG. 4. When the holder 50 is in the position shown in phantom line, the slide member can be pivoted about the tube 18 so as to displace the mouthpiece 12a away from the piston valves to provide the user with substantial freedom of movement.

what has been described is a unique trombone construction which is capable of performing both as a standard slide trombone and as a standard piston valve trombone simultaneously but which obtains musical characteristics greater than either. The trombone can be readily manipulated by operating the piston mechanism with the left hand and the slide mechanism with the right hand, without requiring that either hand be removed from the playing position. Also, the trombone can have the piston valves manipulated with the right hand while the slide assembly is held in position by a holder. By providing a trombone of this construction, the bottom register of the musical scale is substantially extended when utilizing both the piston and the slide mechanisms simultaneously. Accordingly, variations and modifications of this invention may be incorporated without departing from the spirit and scope as set forth in the following claims.

The invention is claimed as follows:

1. A trombone comprising; tubular members having an initial straight portion beginning at a mouthpiece receiving end and terminating in a sound-emanating bell portion, said tubular member including first and second spaced apart tubes, said first tube being held in a pivotal relation to the trombone and said second tube readily pivoted about an axis of said first tube, said second tube having a terminating end extending in a direction opposite that of said mouthpiece receiving end portion and in axial alignment therewith, a slide member having a U-shaped end portion leading into a pair of straight parallel spaced apart portions having open ends telescoping with the terminating ends of said pair of spaced apart tube members to slide therealong for the playing of different musical notes, a plurality of uniformly spaced apart, parallel piston valves positioned in direct communication with said tubular members adjacent said mouthpiece receiving end portion to be manipulated for the playing of different musical notes which can be the same as or different than the musical notes produced by said slide member, and including post means secured to one of said plurality of uniformly spaced apart parallel piston valves and extending in a direction of said mouthpiece receiving end portion, holding means secured to said post and adapted to engage said mouthpiece receiving end portion for holding the same to prevent pivotal movement of said second tube member about the longitudinal axis of said first tube member.

2. In the trombone as set forth in claim 1 wherein said housing means is U-shaped in configuration and pivotal about an axis passing through the plane of the U-shaped member, thereby enabling the U-shaped member to be moved upwardly and downwardly to capture and hold the mouthpiece receiving end portion when in the up position.

3. A trombone comprising; tubular members having an initial straight portion beginning at a mouthpiece receiving end and terminating in a sound-emanating bell portion, said tubular members including first and second spaced apart tubes, said first tube being held in a pivotal relation to the trombone and said second tube readily pivoted about an axis of said first tube, said second tube having a terminating end extending in a direction opposite that of said mouthpiece receiving end portion and in axial alignment therewith, a slide member having a U-shaped end portion leading into a pair of straight parallel spaced apart portions having open ends telescoping with the terminating ends of said pair of spaced apart tube members to slide therealong for the playing of different musical notes, a plurality of uniformly spaced apart, parallel piston valves positioned in direct communication with said tubular members adjacent said mouthpiece receiving end portion to be manipulated for the playing of different musical notes which can be the same as or different than the musical notes produced by said slide member, and means movably supported from at least one of said piston valves and selectively engageable with said mouthpiece receiving end portion to prevent pivotal movement of said second tube member about the longitudinal axis of said first tube member.

4. A trombone as set forth in claim 3 wherein the movable mounted means comprises a pivotally mounted fork adapted to embrace said mouthpiece receiving end portion.

* * * * *

UNITED STATES PATENT OFFICE

CERTIFICATE OF CORRECTION

Patent No. 3,937,116 Dated FEBRUARY 10, 1976

Inventor(s) LAWRENCE RAMIREZ

It is certified that error appears in the above-identified patent and that said Letters Patent are hereby corrected as shown below:

Col. 3, line 64, "member" should be --members--

Col. 4, line 27, "housing" should be --holding--

Col. 4, line 61, "movable" should be --movably--

Signed and Sealed this eighth Day of June 1976

[SEAL]

*Attest:*

RUTH C. MASON
*Attesting Officer*

C. MARSHALL DANN
*Commissioner of Patents and Trademarks*